US007036925B2

(12) United States Patent
Fujiwara

(10) Patent No.: US 7,036,925 B2
(45) Date of Patent: May 2, 2006

(54) PRINTER

(75) Inventor: Hitoshi Fujiwara, Shiojiri (JP)

(73) Assignees: Brother Kogyo Kabushiki Kaisha, Nagoya (JP); F&F Ltd., Shiojiri (JP)

( * ) Notice: Subject to any disclaimer, the term of this patent is extended or adjusted under 35 U.S.C. 154(b) by 123 days.

(21) Appl. No.: 10/344,707

(22) PCT Filed: Aug. 29, 2001

(86) PCT No.: PCT/JP01/07429

§ 371 (c)(1),
(2), (4) Date: Feb. 14, 2003

(87) PCT Pub. No.: WO02/18146

PCT Pub. Date: Mar. 7, 2002

(65) Prior Publication Data

US 2003/0184643 A1 Oct. 2, 2003

(30) Foreign Application Priority Data

Aug. 29, 2000 (JP) ..... 2000-259741

(51) Int. Cl.
*B41J 29/13* (2006.01)
*B41J 3/36* (2006.01)

(52) U.S. Cl. ..... 347/108; 347/109

(58) Field of Classification Search ..... 347/108, 347/109, 152, 170, 222; 400/88, 693; 361/679–686; 708/173

See application file for complete search history.

(56) References Cited

U.S. PATENT DOCUMENTS

| | | | | |
|---|---|---|---|---|
| 4,851,812 A | | 7/1989 | Holmberg | |
| 4,946,300 A | | 8/1990 | Makita | |
| 4,948,283 A | | 8/1990 | Imaizumi et al. | |
| 5,345,403 A | * | 9/1994 | Ogawa et al. | 361/681 |
| 5,646,872 A | * | 7/1997 | Yonenaga et al. | 708/173 |
| 6,405,055 B1 | * | 6/2002 | Silverbrook et al. | 455/556.1 |

FOREIGN PATENT DOCUMENTS

| | | |
|---|---|---|
| DE | 3408594 A1 | 9/1985 |
| EP | 0 501 789 A2 | 9/1992 |
| EP | 0 706 893 A2 | 4/1996 |
| JP | U 61-60354 | 4/1986 |
| JP | A 4-310769 | 11/1992 |
| JP | U 5-75821 | 10/1993 |
| JP | U 5-76751 | 10/1993 |
| JP | A 7-210268 | 8/1995 |
| JP | A 7-334271 | 12/1995 |
| JP | A 9-128091 | 5/1997 |
| JP | A 9-330148 | 12/1997 |
| JP | A 10-301667 | 11/1998 |
| JP | A 2000-184911 | 7/2000 |
| JP | A 2001-130090 | 5/2001 |
| WO | WO 98/17475 A | 4/1998 |
| WO | WO 01/38098 A2 | 5/2001 |

* cited by examiner

*Primary Examiner*—Manish Shah
*Assistant Examiner*—Leonard Liang
(74) *Attorney, Agent, or Firm*—Oliff & Berridge PLC

(57) ABSTRACT

A printer eliminating an installation space on a desk or a floor. A printer has a hook and a housing. The hook is provided on the housing and is locked to a display panel to attach the printer to the display panel. The printer can be installed by making use of a space at a rear surface of the display panel, and a printed sheet can be discharged in the same side as the surface of a display. The printer thus provides easy observation of the printed sheet and easy handling.

15 Claims, 5 Drawing Sheets

PRINTER

TECHNICAL FIELD

The present invention relates to a compact printer and more particularly, to a combination of a printer and a display panel.

BACKGROUND ART

All of the various printers commercially available are installed on the floor or on a desktop for use. Today, how ever, a thin and compact printer is being developed which has a thickness of several cm or even 1 cm or less and which is intended for use as a portable printer, a desktop memo printer or the like. When in use, such a printer is connected to a computer serving as a host. Thus, when the host is a desktop type or a notebook type, the compact printer is accommodated in the device bay for integration, or the printer is formed as a portable one and docked with a PDA, a mobile phone or the like for use, whereby a space saving construction is realized, thus avoiding the inconvenience of arranging or retaining the printer separately from the host.

However, a printer of the type which is to be accommodated in a device bay has to be produced in a size in conformity with the specifications of the device bay. Further, it must allow connection with an interface inside the device bay. Thus, it must be designed and produced as a printer for a specific device bay, which means it has hardly any versatility to other usage. Further, to accommodate the printer in a device bay, it is necessary for that bay to be empty, so that, in some cases, it cannot be used with other peripheral devices, such as a CD-ROM drive.

In the case of the type of printer to be docked with a PDA or the like, a design is required which allows docking with the apparatus on the host side, resulting in a rather poor versatility. Further, when the design of the apparatus on the host side is changed, the printer design has to be also changed in all probability, which is disadvantageous from the economical viewpoint.

In view of this, it is an object of the present invention to provide a printer which is compact, which can be used integrally with various types of computers, which contributes to space saving, and which need not be supported individually. Further, it is another object of the present invention to provide a printer which is of high versatility and which can be used integrally with apparatuses of various manufactures or types.

DISCLOSURE OF THE INVENTION

To achieve the above-mentioned objects, the present invention provides a printer which can be installed at the rear of a display panel and which includes a main body portion and a mounting member provided on the main body portion, in which the mounting member is detachable with respect to the display panel.

This printer can be installed by utilizing the open space on a rear surface of the display panel, whereby space saving can be achieved, and there is no need to effect individual supporting, so that, in use, it provides a feel as if it is integrated with the host. Further, there is no need for the printer to be in conformity with the specifications of a device bay, and it can be mounted for use even if it is not perfectly matched with the configuration, etc. of the host computer. Thus, there are no limitations regarding the size and configuration of the printer main body, making it possible to adopt a versatile design. Further, it is possible to use, integrally with the host, printers of various designs free from constraints of specifications or the like.

Further, in terms of arrangement, the printer involves no conflict with other peripheral devices accommodated in the host, making it possible to realize a more flexible system. Further, in the printer of the present invention, an external interface of the host computer can be used as it is, so that the connection is easy, and the attachment and detachment involve no trouble or nuisance, making it possible to attach the printer to the host as needed.

In the above-described printer, a paper feeding mechanism is provided in the main body portion mentioned above. It is desirable for the paper feeding mechanism to be designed such that when the main body portion is arranged at the rear of the display panel by means of the mounting member described above, a printed sheet is discharged upwardly while being positioned on a display panel surface side of the main body portion. In this construction, when the printer is arranged at the rear of the display panel, the user can check the output result without shifting the line of vision, thus making it possible to provide a printer superior in viewability and operability. Thus, it is possible to provide a printer which is convenient and easy to use as a user interface.

It is desirable that the paper feeding mechanism be able to discharge a sheet with an image or characters printed thereon in an upright state. This will make it possible to immediately read what has been printed on the output sheet.

Further, it is desirable that the main body portion has a stocker at a position above the paper feeding mechanism for storing sheets discharged from the above-mentioned paper feeding mechanism. This will enable the upwardly discharged sheets to be retained at that position.

Further, in the above-mentioned printer equipped with the stocker, it is desirable that the main body portion has a cut sheet accommodating portion for storing cut sheets. Alternatively, it is desirable that the main body portion has a paper roll accommodating portion for storing a roll of paper, and that the paper feeding mechanism described above be equipped with a cutter for cutting the roll of paper. The former construction functions as a cut sheet type printer, whereas the latter construction functions as a paper roll type printer in which the rolled sheet is cut into sheets of appropriate size and are discharged. Further, it is desirable that the above-mentioned mounting member is provided by a hook. Even through a suction cup is also available as the mounting member, the hook is more preferable since it is a jig allowing mounting to be effected easily, safely, and in a stable manner.

Here, it is desirable for the hook to be provided so as to be pivotable with respect to the above-mentioned main body portion and to be capable of functioning as a support allowing the main body portion to stand in a self-sustaining manner. In this construction, the range of selection in terms of printer installation place increase, and the installation is effected in a self-sustaining manner, so that the space occupied can be reduced.

Further, it is desirable for the hook described above to be provided so as to be capable of being engaged with a groove or a protrusion formed on an edge surface of the above-mentioned display panel and at a predetermined distance from the back surface of the display panel in the thickness direction thereof. Because of the engagement of the hook with the groove or the protrusion, it is possible to mount the printer main body reliably to the display panel.

The present invention further provides a display panel including a display member, and a housing having a peripheral edge portion covering an edge portion of the display member and a back surface portion covering the back surface of the display member integrally with the peripheral edge portion, in which the peripheral edge portion has a groove or a protrusion formed at a predetermined distance in the thickness direction of the display member from the back surface of the back surface portion, and in which the groove or the protrusion is engaged with a hook provided on a peripheral device to thereby make the peripheral device detachable. By standardizing the position of the groove or the protrusion so as to be at a predetermined distance in the peripheral edge portion in the thickness direction of the display member from the back surface of the display panel, it is possible for display panels of various thicknesses to be lock with the hook, without having to make any substantial change in design on the display panels of various manufacturers, thus making it possible to attach the peripheral device to various display panels. A compact printer, a floppy disk drive, a CD-ROM drive or the like are conceivable as the peripheral device.

BEST MODE FOR CARRYING OUT THE INVENTION

Figure 1:
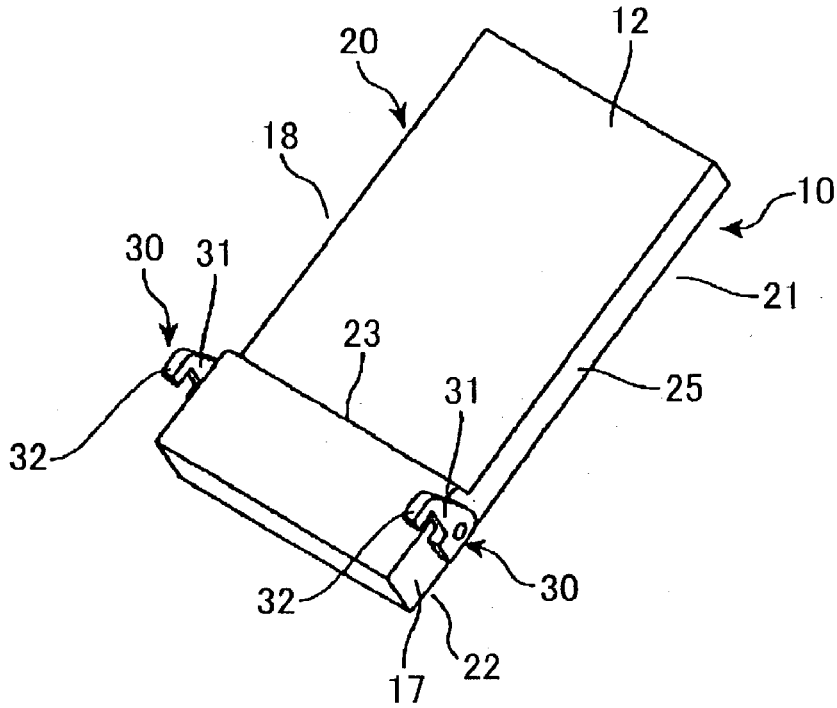
FIG. 1 is a schematic perspective view showing a printer according to a first embodiment of the present invention.
Figure 2:
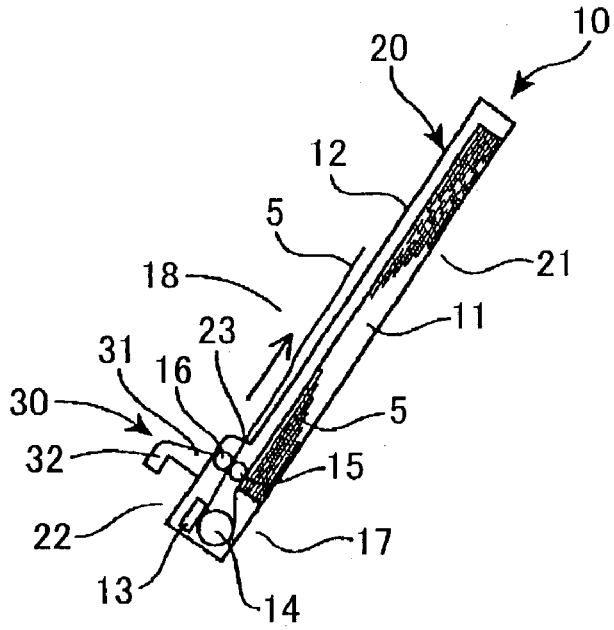
FIG. 2 is a schematic cross-sectional view showing a construction of the printer of FIG. 1.

A printer 10 according to a first embodiment of the present invention will be described with reference to FIGS. 1 through 5. This printer 10 is equipped with a box-like housing 20 having a size of approximately A6 or A7 and a thickness of approximately 1 cm or less. An upper portion 21 of the interior of the housing 20 constitutes a sheet accommodating portion 11 for accommodating cut sheets 5. A front side portion 18 of the upper portion 21 of the housing 20 is somewhat recessed to form a stocker 12 capable of temporarily retaining printed sheets 5. A lower portion 22 of the housing 20 is fat, and contains a printing mechanism 17 composed of a printing head 13, a platen roller 14, a pick-up roller 15, a discharge roller 16, etc. The pick-up roller 15 is arranged between the sheet accommodating portion 11 and the printing mechanism 17, and the discharge roller 16 is arranged between the printing mechanism 17 and the stocker 12. Further, a discharge outlet 23 is formed in the portion of the lower portion 22 facing the stocker 12 (i.e., the lower portion of the stocker 12). The printing mechanism 17 and the discharge roller 16 are constructed such that the printed surface 5*a* (FIG. 3) of the sheet 5 discharged from the discharge outlet 23 onto the stocker 12 is on the visible side, that is, the front surface side. The housing 20 and the components provided therein, i.e., the sheet accommodating portion 11, the printing mechanism 17, etc. form a printer main body portion.

Thus, each of the cut sheets 5 accommodated in the sheet accommodating portion 11 in the upper portion 21 is picked up by the pick-up roller 15 and fed toward the printing head 13. Then, each of the cut sheets 5 undergoes printing while being held between the platen roller 14 and the printing head 13. And, the sheets which have undergone printing are discharged by the discharge roller 16 from the discharge outlet 23 onto the stocker 12 to be accumulated thereon.

A hook 30 serving as a mounting member is mounted to the lower portion of either side surface 25 of the housing 20. Each hook 30 has an arm 31 whose base end portion is pivotally movably mounted to the side surface 25 of the housing 20, and a claw 32 provided at the distal end of the arm 31. The configuration of the claw 32 is such that it is bent downwards when the arm 31 has been pivotally moved to a position where it is substantially at right angles with respect to the housing 20. Thus, by hooking the claw 32 on a recessed portion 55 of a display 52 described below (FIG. 3), the printer 10 as a whole is supported by the display 52.

Figure 3:
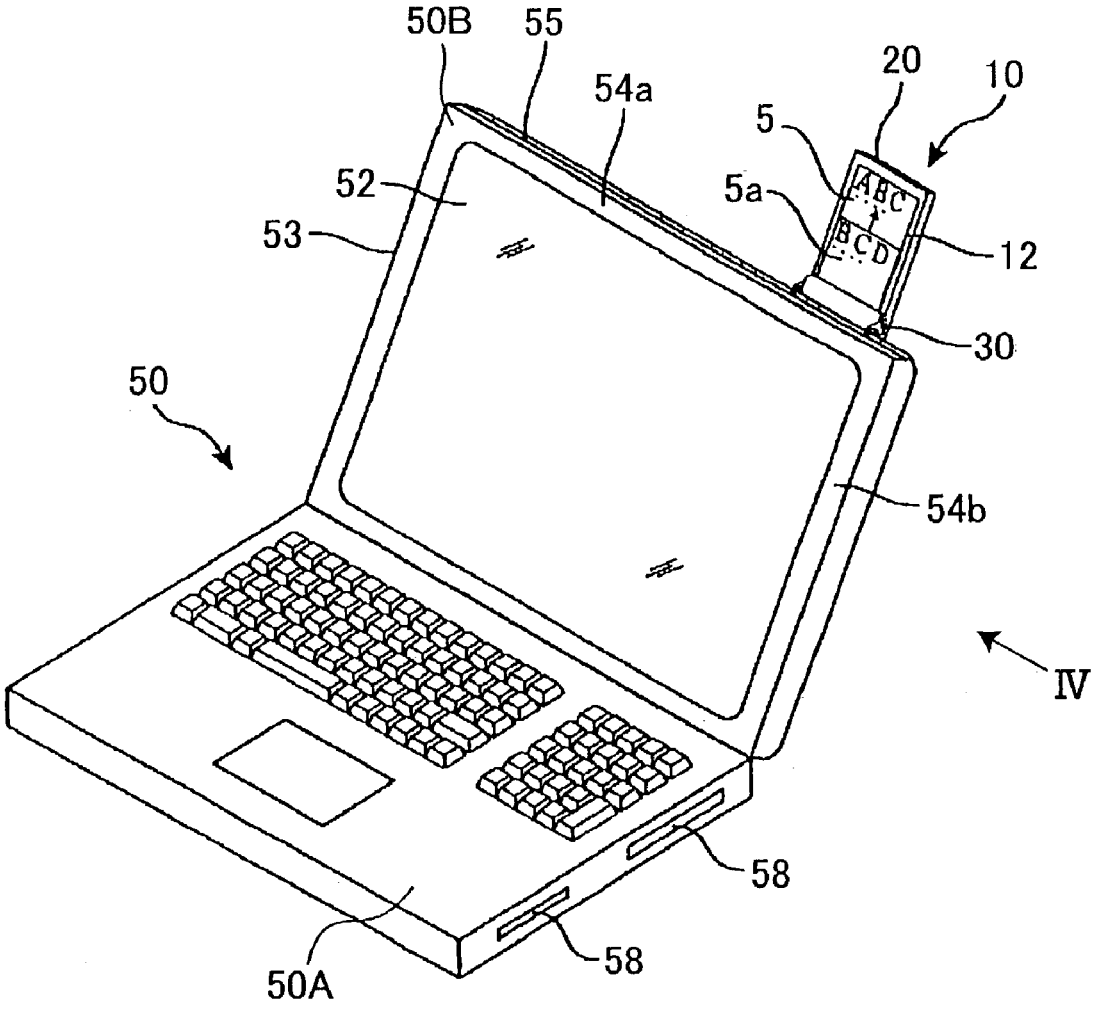
FIG. 3 is a diagram showing the printer of FIG. 1 in a state in which it is attached to the display panel of a notebook type personal computer.

As shown in FIG. 3, a notebook type personal computer 50 serving as the host has a PC main body portion 50A and a display portion 50B. The PC main body portion 50A is equipped with device bays 58 for accommodating therein other peripheral devices, such as a floppy disk drive and a CD-ROM disk drive. The display portion 50B is pivotally movable with respect to the PC main body portion 50A and capable of self-sustaining, and is equipped with the display 52 serving as a display member and a display panel 53 containing the display 52. The display panel 53 has an upper edge frame 54*a* and side frames 54*b*. Substantially in the middle of the upper edge frame 54*a*, there is formed a groove 55 extending in the longitudinal direction (i.e., rightward leftward direction in FIG. 3).

Thus, by inserting the claws 32 of the hooks 30 into the groove 55, it is possible to attach the printer 10 to the side of the display panel 53 on the opposite side of the face of the display 52, that is, a back surface 59 (FIG. 4) of the display panel 53. And, when the printer 10 and the PC main body portion 50A are connected by a USB cable 29 or the like to make the reception of data from the computer 50 serving as the host possible, the printer 10 can be used as a peripheral device of the computer 50.

Further, since the hooks 30 are mounted to the lower portion 22 of the housing 20, when the printer main body portion 20 is mounted to the display panel 53 by means of the hooks 30, the stocker 12 protrudes upwardly from the display panel 53, so that the printed sheet 5 output from the discharge outlet 23 appears on top of the display 52 making it visible to the user of the computer 50. Further, as stated above, the printing mechanism 17, the discharge roller 16, etc. are constructed such that the printed surface 5*a* (FIG. 3) of the sheet 5 discharged from the discharge outlet 23 onto the stocker 12 is on the front surface side, so that the printed surface 5*a* of the sheet when discharged is on the same side as the display 52. Further, from a printer driver installed in the host computer 50, edited image data is sent out such that characters or drawings are printed on the sheet 5 starting from the upper portion thereof, that is, the printed image is in an upright state. Thus, when printing is performed with the printer 10 attached to the upper portion of the display 52, the user can directly observe the sheet 5 as it is discharged with the characters or images being printed thereon. Further, since the characters or images is output in an erect state, it is possible to visually follow and grasp or confirm what is being printed on the sheet 5.

In this way, the printer 10 can be installed at the rear of the display panel 53 by means of the hooks 30, and can be attached or detached freely with respect to the display panel. Thus, when the printer 10 is to be used, it can be installed by utilizing the open space of the back surface 59 of the display panel 53, whereby space saving results. When the printer 10 is not used, it can be easily separated from the host computer 50 solely by detaching the hooks 30, so that it does not constitute an obstruction when the display panel 53 is closed. Further, since the printer 10 can be stored or carried separately from the computer 50, it allows flexible selection in terms of storage space, carrying space, carrying method, etc., so that it can be used in various modes according to the situation and condition of the user.

Further, since the printer 10 can be supported solely by hooking the hooks 30, there is no need to separately provide a printer support stand or the like. And, during use, the computer 50 constituting the host and the printer 10 are integrated, so that the printer can be used as if it were one of the peripheral devices accommodated in the device bays. And yet, it need not be accommodated in a device bay, so that it does not have to be in conformity with the specifications of a device bay. Further, since it can be mounted for use even if it is not perfectly matched with the configuration, etc. of the host computer 50, it provides a high degree of freedom in design, making it possible to adopt a design that is versatile to various kinds of host computers of different manufacturers.

Further, since the printer 10 can be supported by hooking it on the upper edge frame 54*a*, it involves no conflict in arrangement with the other peripheral devices, such as a floppy disk drive and a CD-ROM disk drive, accommodated in the device bays 58 of the host computer 50, and can be mounted to the host 50 and used together with these devices. Thus, it is possible to realize a still more flexible system around the host computer 50. Further, since the printer 10 is attached to the outer portion of the computer 50, the external interface of the host computer 50 can be used as in the case of a conventional desktop type printer. Thus, the cable 29 can be connected easily, and there is no trouble or nuisance involved in the attachment and detachment of the cable, making it possible to attach the printer 10 to the host 50 as needed.

Further, when the printer 10 is mounted to the display panel 53, the stocker 12 is situated at a position above the display 52, and the sheet 5 which has undergone printing is output above the display 52 so as to be visible to the user. Thus, the user can immediately read what has been printed on the output sheet 5 scarcely shifting the eyes from the display 52, which means that the printer 10 can be used such that the user can easily confirm the print output. Thus, the printer 10 is very useful as a user interface for data output.

Figure 5:
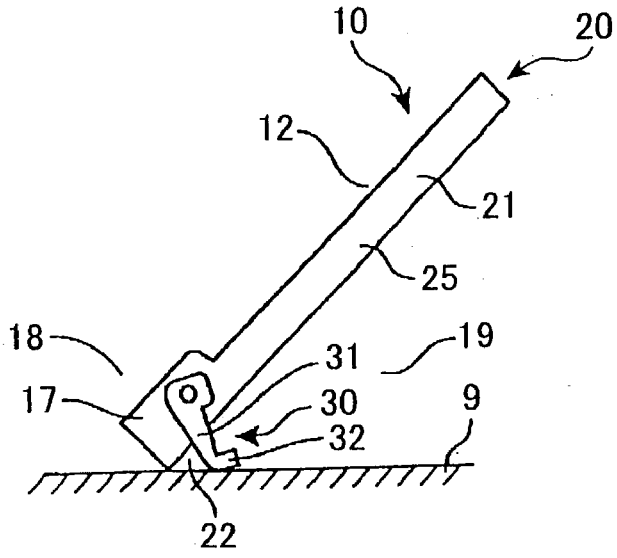
FIG. 5 is a diagram showing the printer of FIG. 1 placed on a desktop in a self-sustaining state.

Further, the arm 31 of each hook 30 of the printer 10 is capable of swiveling. As shown in FIG. 5, when the arm 31 swivels from the front side 18 to a rear side 19, the printer 10 is enabled to stand on a desk 9 or the like in a self-sustaining manner like a bookstand or a photo frame. Thus, it is also possible for the printer 10 to be placed on a desktop for use without being hooked on the display panel. In doing so, as in the case in which the printer is hooked on the back surface of the display panel 53, the printing mechanism 17, the stocker 12, and the sheet accommodating space 11 can be arranged in the vertical direction, with the printing mechanism 17 being in the lower portion so as to discharge sheets onto the stocker 12 in the upper portion. Thus, also in the case where the printer 10 is installed on the desk 9 or the like, the printer 10 occupies very little space. And, the sheet is discharged upwardly and data is supplied from the host such that the characters or image is sequentially printed in an erect state starting with the upper portion thereof, whereby it is possible to read or confirm the content of output while the printed sheet is being discharged.

It is certainly difficult to standardize the thickness of the display panel 53, which varies in size according to the manufacturer, and it is a bother to use hooks 30 of different sizes for different display panels. However, even if the display panel varies in thickness, when it is standardized such that the groove 55 is formed in the upper surface of the upper edge frame 54*a* at a predetermined distance from the back surface 58, it is possible to engage the claws 32 with the groove 55 at positions at the predetermined distance from the back surface, without having to make any substantial design change in display panels of different manufacturers. When such a design is adopted by different manufacturers as a standard for all display panels, it is possible to provide a highly versatile printer 10 which can be attached to these display panels.

Figure 6:
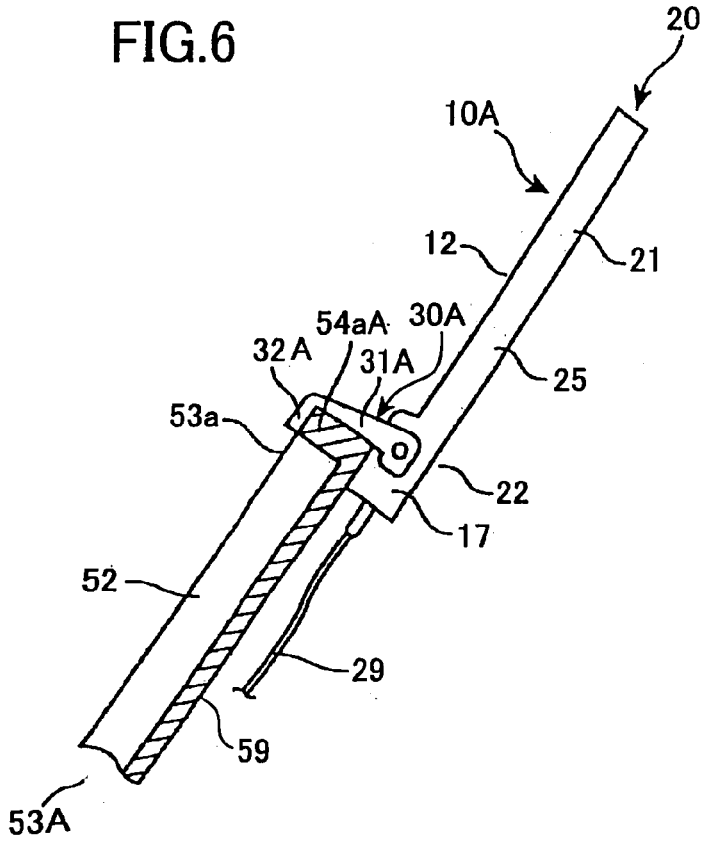
FIG. 6 is a side view, partly in section, of a printer according to a second embodiment of the present invention in a state in which it is attached to a display panel whose configuration is different from that shown in FIG. 4.

FIG. 6 shows a printer 10A according to a second embodiment of the present invention. In this embodiment, no groove or protrusion is provided on the upper edge frame 54*a*A of the display panel 53A, and, taking into account the thickness of the display panel 53A, the arm 31A of each hook 30A is long enough to allow the claw 32A to be locked with the front surface 53a of the display panel 53A.

Figure 4:
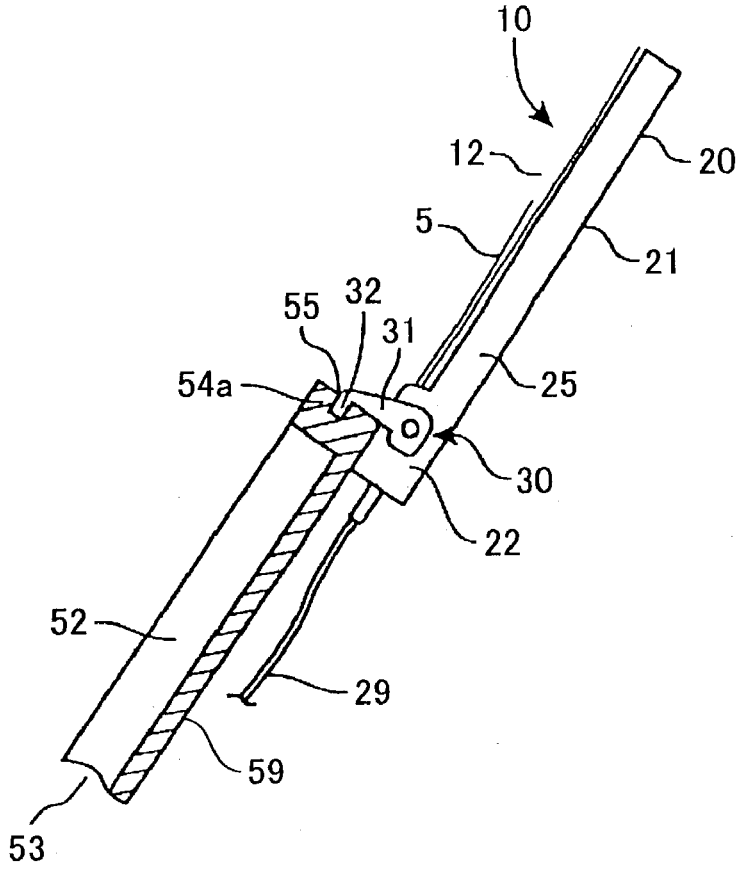
FIG. 4 is a side view, partly in section, of the printer of FIG. 1 attached to the display panel as seen from the direction of the arrow IV of FIG. 3.
Figure 7:
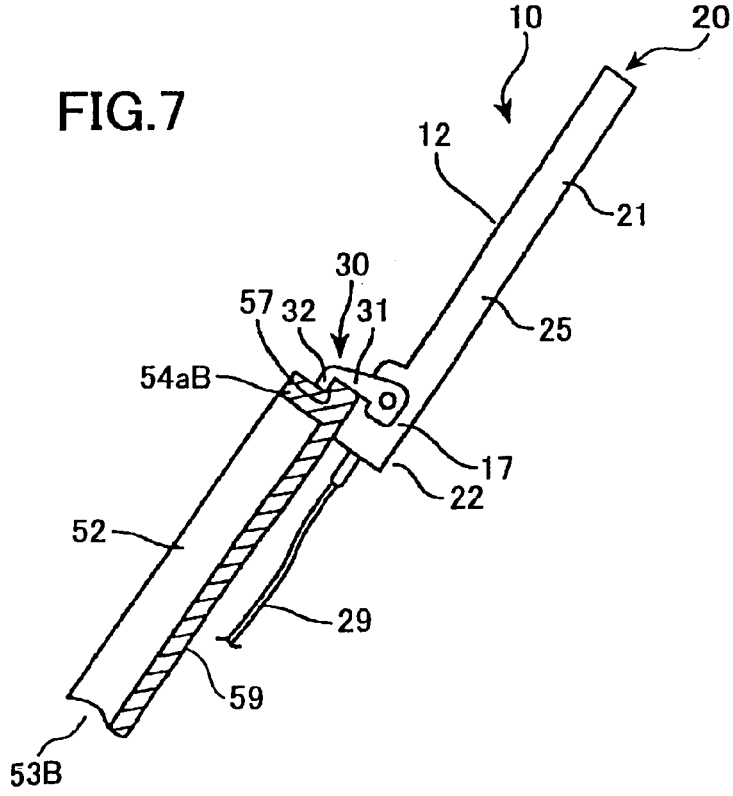
FIG. 7 is a side view, partly in section, of a printer according to the present invention in a state in which it is attached to a display panel whose configuration is different from those shown in FIGS. 4 and 6.

FIG. 7 shows the printer 10 of the first embodiment of the present invention in a state in which it is supported by a display panel 53B of a configuration different from those of the display panels 53 and 53A shown in FIGS. 4 and 6. Instead of the groove in the upper edge frame 54*a*B, this display panel 53B has a step 57, to which the claws 32 are locked.

Figure 8:
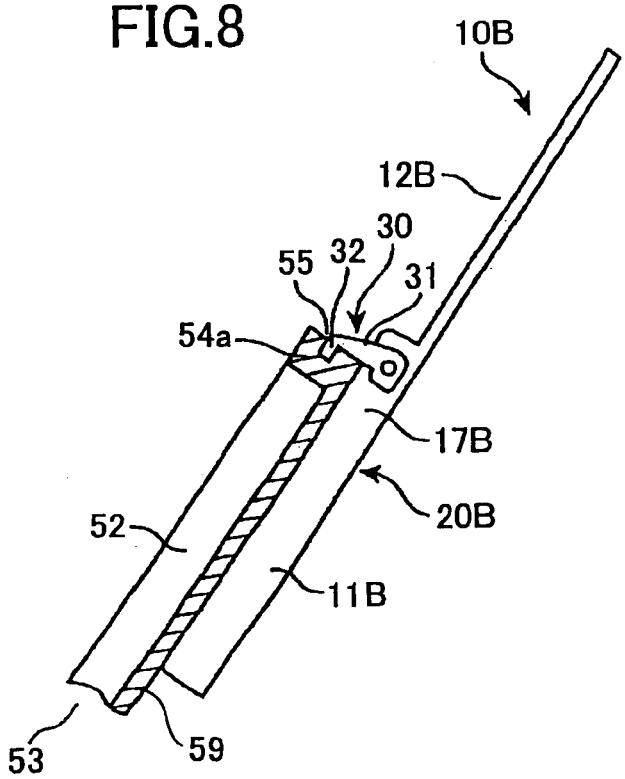
FIG. 8 is a side view, partly in section, of a printer according to a third embodiment of the present invention in a state in which it is attached to a display panel.

FIG. 8 shows a printer 10B according to a third embodiment of the present invention. As shown in FIG. 8, a sheet accommodating portion 11B for storing cut sheets extends on the side opposite to a stocker 12B with respect to a printing mechanism 17B, and the sheet accommodating portion 11B is in plane contact with the back surface 59 of the display panel 53B.

Figure 9:
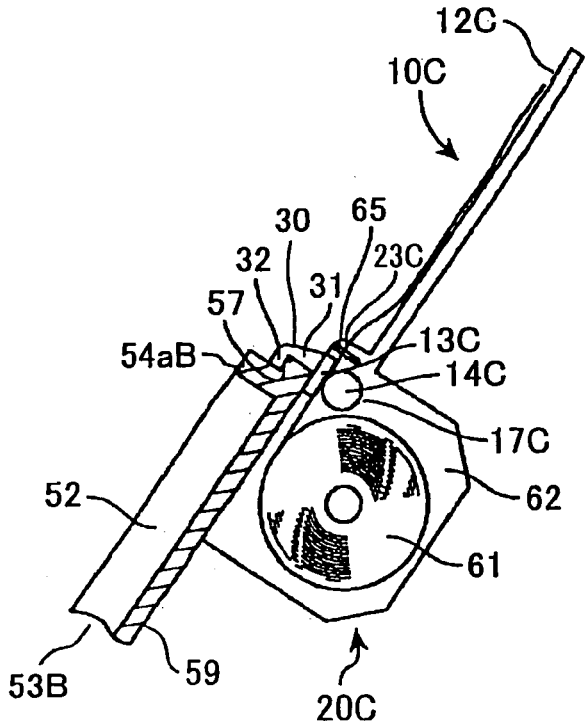
FIG. 9 is a side view, partly in section, of a printer according to a fourth embodiment of the present invention in a state in which it is attached to the display panel shown in FIG. 7.

FIG. 9 shows a printer 10C according to a fourth embodiment of the present invention. The components which are the same as those of the first embodiment are indicated by the same reference numerals with symbol C added thereto, and a description of such components will be omitted. In this printer 10C, an accommodating portion 62 capable of accommodating a roll of paper 61 is provided in the housing 20C. In this case, it is desirable to arrange a cutter 65 in the vicinity of the discharge outlet 23C so that the paper can be discharged after being cut into sheets of a predetermined size. Further, it is desirable to provide a curl removing mechanism (not shown) so that the paper can be output after being flattened.

The printer and display panel of the present invention are not restricted to those of the above-described embodiments but various modifications can be made. For example, a mechanism for adjusting the length of the arms of the hooks can be provided.

Further, it is possible to attach a peripheral device such as a printer by means of hooks not only to the display panel of a notebook type computer but also to a liquid crystal display panel of a desktop computer or the like without departing from the scope of the present invention.

Further, the printing mechanism is not restricted to the thermal type using the thermal head 13, 13C, other type printing mechanism such as the ink-jet type is also available. However, in designing a compact and thin printer to be attached to the back surface of a display panel, the thermal type printing mechanism, which requires no consumables such as ink and no space for accommodation, is more suitable. Instead of a platen roller which is a component of the mechanism for printing on heat-sensitive papers, a non-roller type platen is also available.

Further, the printer of the present invention is not restricted to A6 size (105×148 mm) and A7 size (74×105 mm), it may also be a printer capable of printing on an A4 size sheet. However, as the printer of the present invention, a compact printer capable of printing on a small size sheet, such as an A6, A7, or A8 size sheet, is more suitable since the printer can be easily attached and detached and can be carried about together with a notebook type personal computer or the like.

Further, regarding the mounting member for mounting the printer 10 to the back surface of the display panel, it is also possible to use some other member such as a suction cup instead of the hooks. However, as compared with the system using the suction cup or the like, in which the suction force depends upon the configuration and material of the back surface of the display panel, the system in which the printer is mechanically hung on the edge of the display panel by means of hooks is more preferable in that it allows the mounting to be effected easily, safely, and in a stable manner. Further, the latter system allows easy attachment and detachment and is highly versatile, in particular, high versatility is realized by providing a recessed portion to be engaged with hooks at a predetermined position on the display panel side as described above.

Further, the present invention is not restricted to a printer. It is also possible to attach hooks as described above to some other peripheral device and mount it to a display panel. For example, devices which are normally accommodated in device bays, such as a floppy disk drive and a CD-ROM drive, can also be attached to a display panel by means of hooks as in the case of a printer. For this purpose, the housing of a drive device may be equipped with hooks as in the case of a printer. Further, it is possible to prepare a basket or belt with hooks mounted thereto and to put a peripheral device in the basket or belt, or to prepare a hooked adapter to mount hooks to the housing of a peripheral device to be attached to a display panel. In this way, a peripheral device can be attached to a display panel by a variety of methods. In this case, it is possible to install various peripheral devices integrally with a computer by utilizing the empty space at the rear surface of the display panel, without involving any conflict with the peripheral devices mounted in the device bays. Further, also in the case of a notebook type personal computer having no device bays, peripheral devices can be installed integrally with the computer by utilizing the empty space on the back surface of the display panel without being arranged on the desktop in an octopus-leg-like fashion.

The invention claimed is:

1. A printer, comprising:

a main body portion; and a mounting member provided on the main body portion, the mounting member being detachably attached with respect to a display panel and oriented in an approximately vertical direction for installing the main body portion to the display panel, at least a part of the main body portion being supportedly positioned behind the display panel when the mounting member is engaged with the display panel, wherein the main body portion comprises a paper feeding mechanism, a printed sheet being discharged upwardly while being positioned on a display panel surface side of the main body portion when the main body portion is arranged at a rear side of the display panel by the mounting member.

2. The printer according to claim 1, wherein the paper feeding mechanism discharges a sheet with an image or characters printed thereon in an upright state.

3. The printer according to claim 1, wherein the main body portion is further provided with a stocker at a position above the paper feeding mechanism for storing sheets discharged from the paper feeding mechanism.

4. The printer according to claim 3, wherein the main body portion is further provided with a cut sheet accommodating portion for storing cut sheets.

5. The printer according to claim 3, wherein the main body portion is further provided with a paper roll accommodating portion for storing a roll of paper, and the paper feeding mechanism is equipped with a cutter for cutting the roll of paper.

6. A printer, comprising:

a main body portion; and a mounting member provided on the main body portion, the mounting member being detachably attached to an edge portion with respect to a display panel and oriented in an approximately vertical direction for installing the main body portion to the display panel, at least a part of the main body portion being supportedly positioned behind the display panel when the mounting member is engaged with the display panel, wherein the mounting member comprises a hook, and the hook is pivotally movably supported to the main body portion, and also serves as a support allowing the main body portion to stand in a self-sustaining manner.

7. The printer according to claim 6, wherein the hook is engageable with a groove or a protrusion formed on an edge surface of the display panel and at a predetermined distance from a back surface of the display panel in a thickness direction thereof.

8. A printer, comprising:

a main body portion including a stocker for accumulating therein discharged sheets; and a mounting member provided on the main body portion and detachably attached to a display panel, wherein the main body portion is provided with a sheet accommodating portion for storing therein papers, the sheet accommodating portion being positioned at a rear side of the stocker when the main body is supportedly positioned behind the display panel through the mounting member.

9. The printer according to claim 8, wherein the main body portion is formed with a sheet discharge opening positioned at a front surface side of the main body portion when the main body portion is supportedly positioned behind the display panel through the mounting member.

10. The printer according to claim 8, wherein the main body portion is further provided with a paper feed mechanism for discharging each paper accommodated in the sheet accommodating portion toward the stocker through a U-shaped paper discharge passage provided in the main body portion.

11. A printer, comprising:

a main body including a stocker for accumulating therein discharged sheets; and a mounting member provided on the main body portion and detachably attached to a display panel, wherein the main body portion is further provided with a paper feed mechanism, the stocker being positioned above the paper feed mechanism.

12. The printer according to claim 11, wherein each mounting member is provided at each lateral side of the main body portion, a paper discharge passage being positioned internally between the mounting members for discharging papers therealong.

13. The printer according to claim 11, wherein the main body portion is formed with a sheet discharge opening positioned at a front surface side of the main body portion when the main body portion is supportedly positioned behind the display panel through the mounting member.

14. A printer, comprising:

a main body portion including a stocker for accumulating therein discharged sheets; and a mounting member provided on the main body portion and detachably attached to a display panel, wherein the stocker has a major area protruding upwardly from an upper edge of the display panel when the main body portion is supportedly positioned behind the display panel through the mounting member.

15. The printer according to claim 14, wherein the main body portion is formed with a sheet discharge opening positioned at a front surface side of the main body portion when the main body portion is supportedly positioned behind the display panel through the mounting member.

* * * * *